United States Patent [19]

Freese

[11] Patent Number: 4,840,515

[45] Date of Patent: Jun. 20, 1989

[54] SUBTERRANEAN DRAIN

[75] Inventor: James S. Freese, Charlotte, N.C.

[73] Assignee: Mirafi, Inc., Charlotte, N.C.

[21] Appl. No.: 938,507

[22] Filed: Dec. 5, 1986

[51] Int. Cl.[4] ..... E02B 11/00

[52] U.S. Cl. ..... 405/45; 52/169.5; 52/169.14; 405/36; 405/43; 428/166; 428/178

[58] Field of Search ..... 405/36, 45, 43, 44, 405/47, 48; 428/178, 166, 116; 52/169.5, 169.14, 788, 806, 805, 804, 799, 797

[56] References Cited

U.S. PATENT DOCUMENTS

| | | | |
|---|---|---|---|
| 3,561,177 | 2/1971 | Agro et al. | 52/169.14 X |
| 3,654,765 | 4/1972 | Healy et al. | 52/169.5 X |
| 3,888,087 | 6/1975 | Bergsland | 52/169.5 X |
| 4,057,500 | 11/1977 | Wager | 405/43 X |
| 4,490,072 | 12/1984 | Glasser | 405/45 |
| 4,572,700 | 2/1986 | Mantarro et al. | 405/45 X |
| 4,574,541 | 3/1986 | Raidt et al. | 405/45 X |
| 4,631,221 | 12/1986 | Disselbeck et al. | 428/178 |

FOREIGN PATENT DOCUMENTS

| | | | |
|---|---|---|---|
| 2056236 | 3/1981 | United Kingdom | 405/45 |

*Primary Examiner*—Dennis L. Taylor

*Attorney, Agent, or Firm*—Kane, Dalsimer, Sullivan, Kurucz, Levy, Eisele and Richard

[57] ABSTRACT

A subterranean drainage unit for protecting a structure by intercepting subsurface fluid flows, comprising a sheet base member having parallel first and second planar surfaces, regularly spaced discrete frusto-conical members projecting from the first planar surface creating intersecting channels to allow for lateral and vertical uninterrupted flow of fluid, the second planar surface being constructed and arranged to cohesively adhere to the surface of the structure being protected and a filter media supported by the projections to maintain a substantially rigid surface which is non-interfering with the flow of fluid within the intersecting channels.

9 Claims, 5 Drawing Sheets

SUBTERRANEAN DRAIN

BACKGROUND OF THE INVENTION

Proper drainage is an important consideration in the design and construction of subterranean walls. In the absence of proper drainage, hydrostatic pressure can result in severe structural damage, weakening walls and causing leaking conditions.

The problem of proper drainage has been addressed historically through the use of well known aggregate drainage systems with resultant costly and time consuming installation. In recent years, solutions have been sought through the utilization of a subterranean wall drain system comprising a generally horizontally disposed drain pipe having openings therein and a generally vertically disposed longitudinal planar core defining channels normal to the pipe with water pervious sheet material covering at least the core and the openings in the pipe to form a filter therefor. Such systems are exemplified in U.S. Pat. Nos. 3,563,038 and 3,654,765, issued in the names of Kent A. Healy and Richard P. Long, entitled respectively "Subterranean Drain" and "Subterranean Wall Drain".

The Healy/Long patents provided a prefabricated drainage system adopted for use in a variety of soil conditions and types. The system is less costly than prior art systems since it provided a prefabricated unit which can be installed easily and by relatively unskilled personnel.

Others have followed the Healy/Long concept in providing alternate specific designs. One of these prior art designs is shown in the drawings in FIGS. 1A and 1B, labeled "prior art". The drain shown in FIGS. 1A and 1B has continuous intersecting walls 10 formed by depressions 12 on each side running in directions generally angular to its vertical and horizontal edges. Raised mountains 14 are formed at the intersections of the walls 10. On one side the mountains support a filter fabric 16 and on the remaining side abut the structure being protected so that the member is in spaced relationship thereto. Although this design has been successful, improvements can be made thereon.

SUMMARY OF THE INVENTION

The present invention provides a thin lightweight sheet having regularly spaced discrete frusto-conical members projecting therefrom upon which a filter member is disposed. The side of the sheet without the projecting members is planar so that it can be readily and cohesively adhered to the surface of the structure being protected. The sheet, on the side of the projecting members is also planar with the members projecting therefrom, allowing uninterrupted flow between the projecting members, approaching laminar flow. Interlocking means are available for joining one sheet to another during installation.

The invention finds use in many applications, including protection of a retaining wall or foundation wall, as a land-fill drain and for edge drain applications such as along highways.

DESCRIPTION OF THE PREFERRED EMBODIMENTS

Figure 1A:
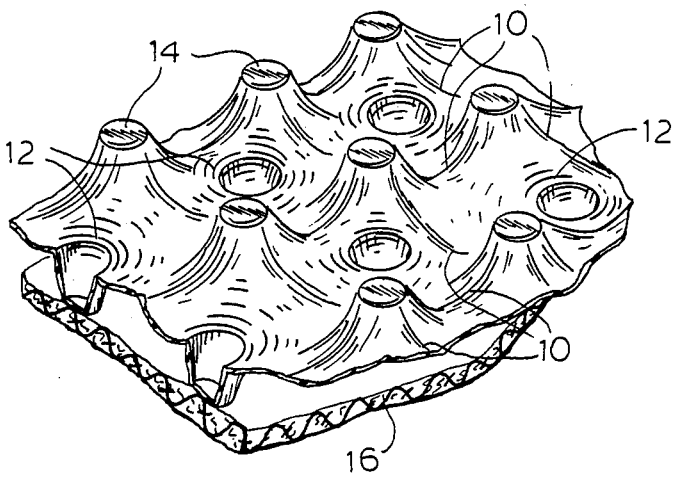
FIG.1A PRIOR ART
FIGS. 1A and 1B are respectively fragmentary perspective and planar views of a prior art subterranean drain.
Figure 1B:
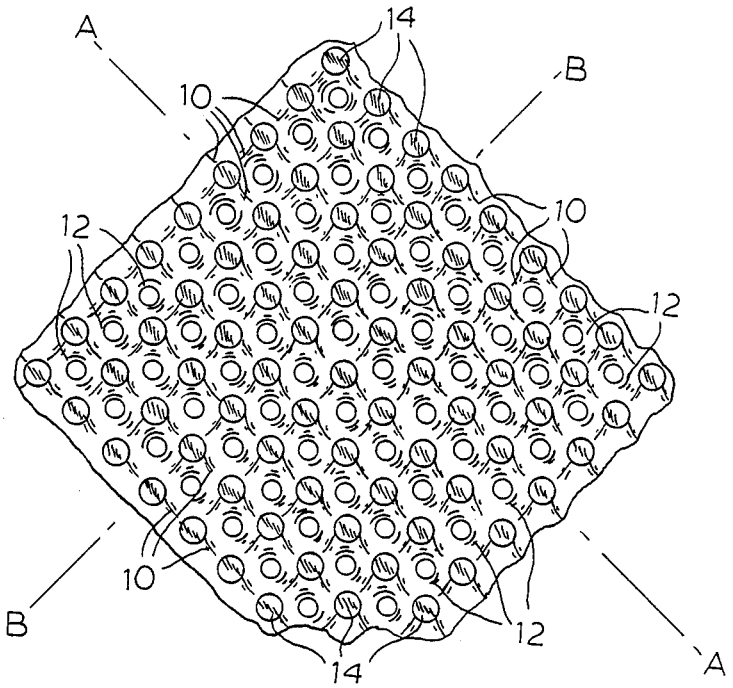
FIG.1B PRIOR ART
Figure 3:
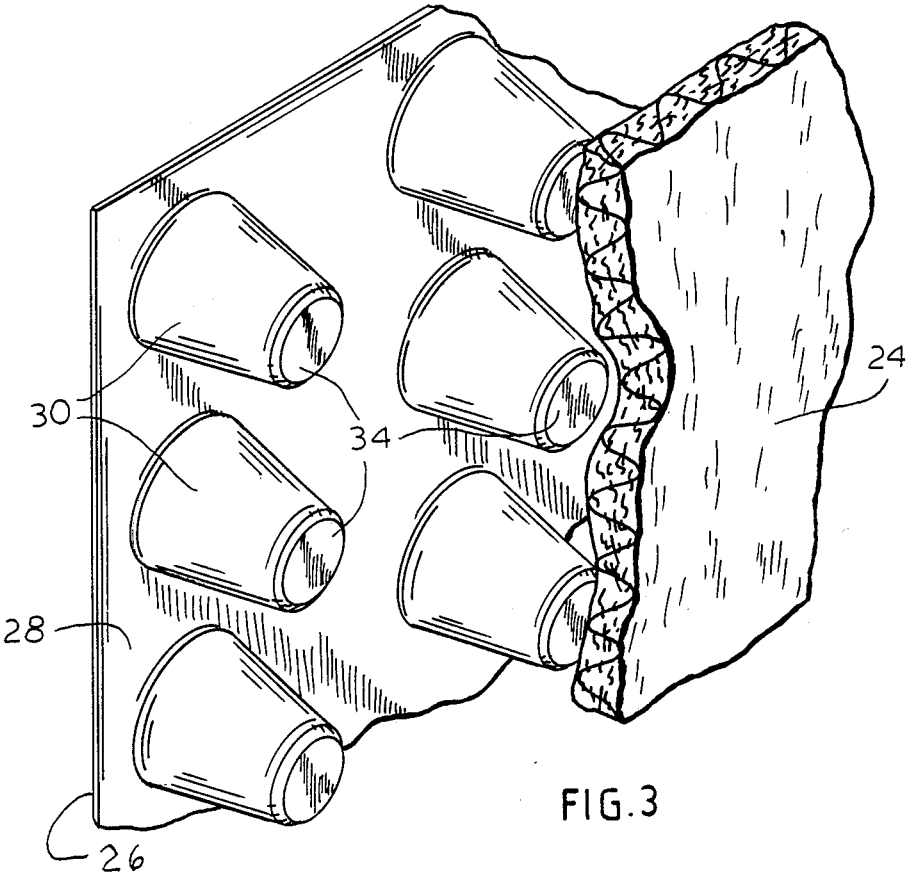
FIG. 3 is an exploded fragmentary perspective view of sheet member and filter of the drain of the invention.
Figure 2:
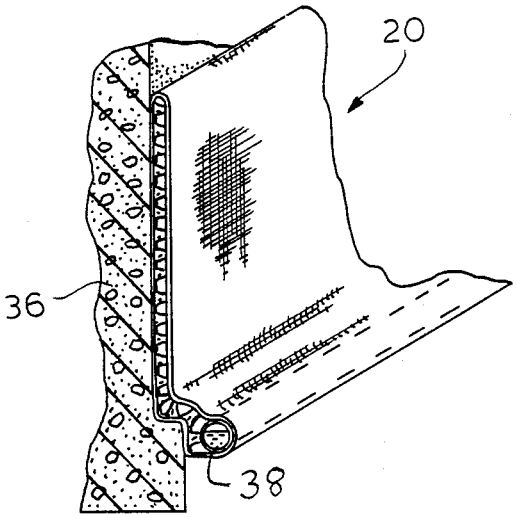
FIG. 2 is a fragmentary perspective view of a subterranean drain constructed in accordance with the teaching of this invention, installed.

The subterranean drain which is the subject of this invention is shown in FIGS. 2 through 7 and indicated therein generally by the numeral 20. It consists of a lightweight, three-dimensional, high impact polymeric base member 22 and filter fabric 24. The base member is sheet-like having planar surfaces 26 and 28 respectively on either side thereof, which will be referred to herein as the backside and frontside respectively.

Frusto-conical projecting members 30 project from the surface of the frontside 28 of the base member 22. The base member is thermoformed of materials having characteristics suitabe for end product use. Polystyrene is used when its characteristics of high impact resistance and resistance to creep are desireable. It absorbs and gives up heat rapidly so that fast production is possible. Its chemical properties must be considered in view of the environment of the end use. PVC and high density polyethelene have also been used. The latter has good chemical resistance but poor creep resistance while the former is not quite as chemical resistant as high impact polystyrene but has better creep resistance than polyethelene.

The manner in which each of the projections 30 is formed results in it being hollow and having a recess 32 on the back side of the base member. Top flat surface 34 of each projection allows for bonding of the filter media thereto. The dimensions of the projections are selected to provide the best combination of strength and height to provide good flow while having sufficient crush resistance for the applications for which it is designed. The projections are uniform in rows and columns generally parallel and perpendicular to the edge of the base and spaced equally from each other to provide multiflow paths. The frusto-conical configuration provides clean uninterrupted flow paths and good adhesion zones for the filter fabric.

The filter media 24 is a pervious sheet material. In the preferred embodiment it is a non-woven, needle punched polypropylene. Other types such as spunbonded or woven could also be used. The fabric 24 is bonded to the surfaces 34 of the base by a melt glue to maintain a substantially rigid surface. Other methods of attaching may be utilized. The filter fabric allows water to pass freely into the flow channels while preventing backfill from entering the flow channels. Gravity draws the water through the flow channels to a suitable discharge system.

Figure 4:
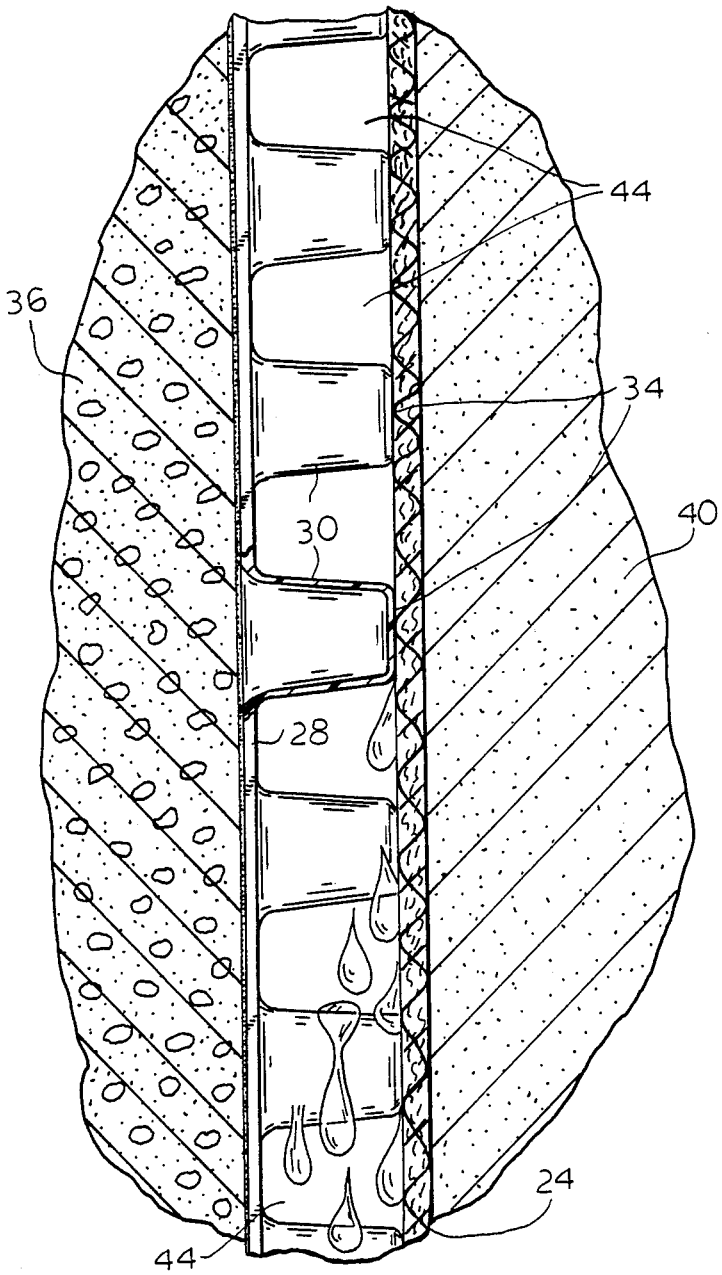
FIG. 4 is an enlarged fragmentary sectional view of the drain of the invention installed.

FIG. 4 shows a typical installation wherein the concrete structure to be protected is indicated by the numeral 36. In this installation, the discharge system is drain pipe 38 which has holes in it to receive the water. The pipe then carries the water away. It is noted that the filter media wraps the pipe to prevent clogging of the holes therein.

A unique feature of the present system is in the interlocking means provided for joining adjacent drains 20. As seen primarily in FIGS. 5, 6 and 7, the frusto-conical configuration of the projections 30 and the hollow core 32 thereof allows for male-female union of the projections of different drain panels for joining.

Figure 7:
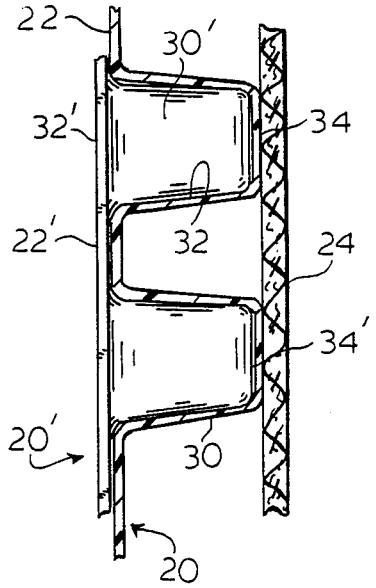
FIG. 7 is an enlarged sectional view taken along the line 7—7 in the direction of the arrows in FIG. 6.
Figure 6:
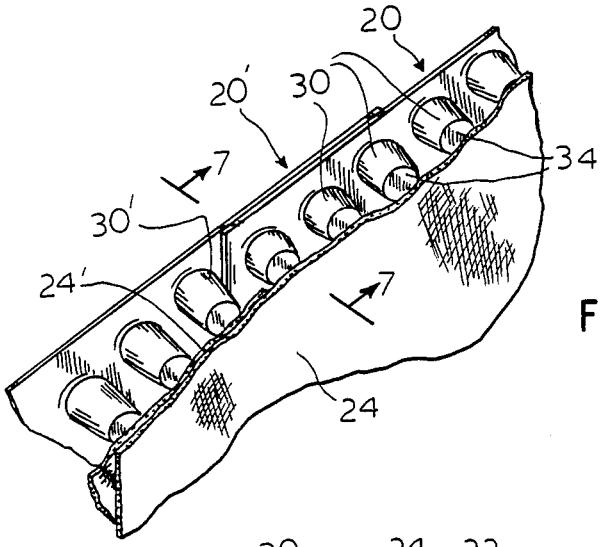
FIG. 6 is a perspective view illustrating the panels of FIG. 5 in interlocked condition.
Figure 5:
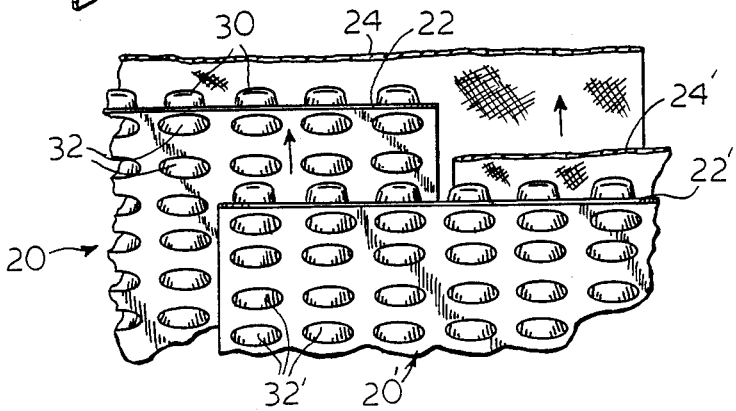
FIG. 5 is an exploded fragmentary perspective view of two panels in the process of being interlocked.

As seen in FIGS. 5 and 7, the fabric 24' of drain 20' can be cutback or folded back so that it is foreshortened thereby exposing three columns of projections 30' which can penetrate the recesses 32 of three columns of projections in drain 20. The filter fabric is extended beyond the edges of the base member to provide overlap with adjacent panels and discharge pipe. In use the drain is suitably placed in position adjacent the structure to be protected, such as the concrete wall 36 shown in FIGS. 2 and 4 with the backside embracing the wall. The earth/sand/water composite is indicated by the numeral 40 and droplets of water 42 are illustrated passing through filter media 24 and by gravity downwardly in the channels 44 to the drain pipe 38.

Figure 8:
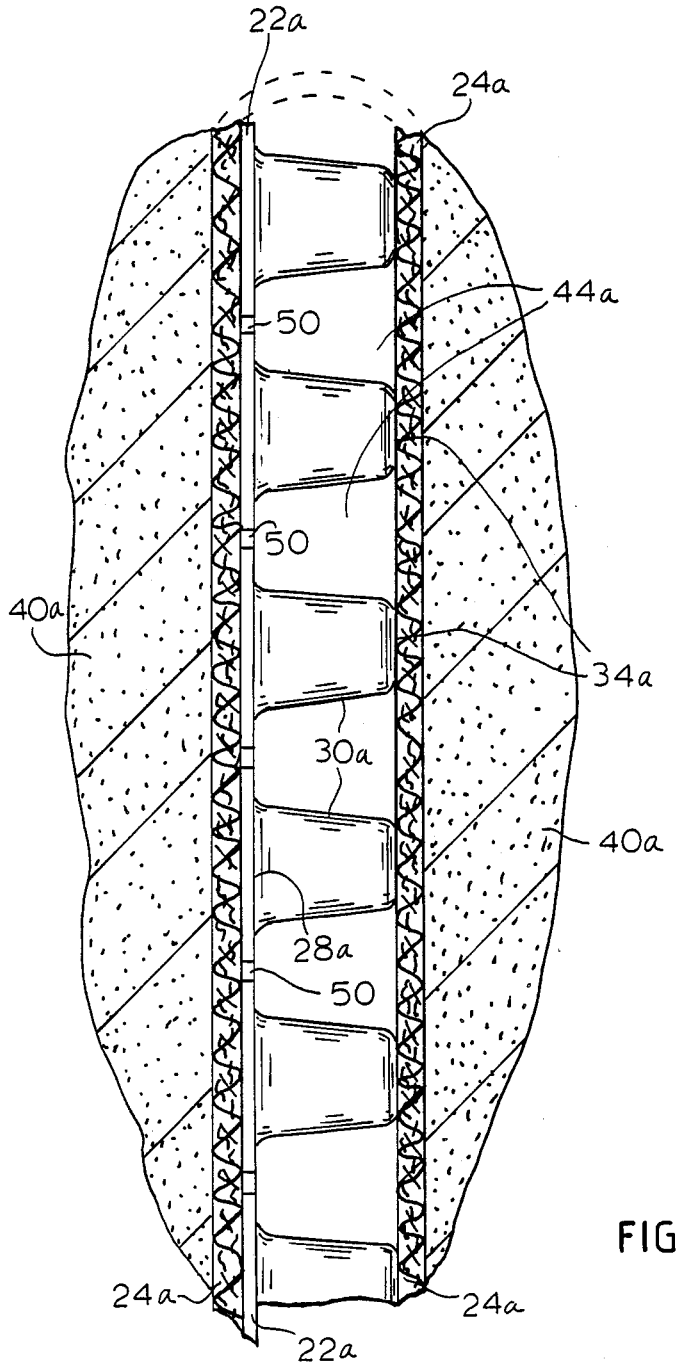
FIG. 8 is a view similar to FIG. 4 showing an alternate embodiment of the invention.

In FIG. 8, which is a view similar to FIG. 4 an alternate embodiment of the invention is shown in which like numbers are used to indicate parts similar to those shown in FIG. 4 but with an 'a' following. The embodiment of FIG. 8 differs from that of FIG. 4 in that in FIG. 8, holes 50 are provided in the base 22 to provide for applications where drainage into the flow channels from both sides is desirable, as for example where the soil 40a is on each side.

In such applications the filter media 34a would cover both sides in order to prevent backfill entering the flow path through the holes 50.

Thus among others, the several objects of the invention have been achieved. Clearly modifications can be made which remain within the scope of the invention as defined by the appended claims.

I claim:

1. A subterranean drainage unit for protecting a structure by intercepting subsurface fluid flows, comprising a sheet base member having parallel first and second planar surfaces, regularly spaced discrete frusto-conical members projecting from said first planar surface members intersecting channels to allow for lateral and vertical uninterrupted flow of fluid, said second planar surface being constructed and arranged to cohesively adhere to the surface of said structure being protected and a filter media supported by said projections to maintain a substantially rigid surface which is non-interfering with the flow of fluid within said intersecting channels.

2. A subterranean drainage unit in accordance with claim 1 in which said conical members are provided with flat surfaces, substantially parallel to said first planar surface whereat said filter media is supported.

3. A subterranean drainage unit in accordance with claim 1 in which said conical member are of frusto-conical configuration allowing unimpeded flow in said channels and providing surfaces for bonding said filter media thereto.

4. A subterranean drainage unit in accordance with claim 1 in which said conical members are hollow providing for interlocking of like drainage units by male-female union of projections on said units.

5. A subterranean drainage unit in accordance with claim 1 in which the filter media is no-woven and water pervious.

6. A subterranean drainage unit in accordance with claim 1 in which a drainage means is provided and covered by said filter media.

7. A subterranean drainage unit in accordance with claim 6 in which said drainage means is a drain pipe having holes therein in the zones covered by said filter media.

8. A subterranean drainage unit in accordance with claim 1 in which holes are provided in said unit allowing liquid to flow from said second side to said first side.

9. A subterranean drainage unit in accordance with claim 8 in which filter media adjacent said second side covers said holes.

* * * * *